US006391170B1

(12) United States Patent
Day et al.

(10) Patent No.: US 6,391,170 B1
(45) Date of Patent: May 21, 2002

(54) ANODE BOX FOR ELECTROMETALLURGICAL PROCESSES

(75) Inventors: Forrest B. Day, Farmington; Michael Rytting, Orem; Steven S. Davis, Farmington, all of UT (US)

(73) Assignee: EnviroTech Pumpsystems, Inc., Salt Lake City, UT (US)

( * ) Notice: Subject to any disclaimer, the term of this patent is extended or adjusted under 35 U.S.C. 154(b) by 0 days.

(21) Appl. No.: 09/728,010

(22) Filed: Dec. 1, 2000

(51) Int. Cl.[7] ..... C25B 9/00

(52) U.S. Cl. ..... 204/279; 204/281; 204/286.1; 204/287

(58) Field of Search ..... 204/279, 281, 204/286.1, 287

(56) References Cited

U.S. PATENT DOCUMENTS

| | | | | |
|---|---|---|---|---|
| 3,703,358 A | * | 11/1972 | Carson, Jr. et al. | 423/657 |
| 3,979,275 A | * | 9/1976 | Harvey et al. | 204/268 |
| 3,981,353 A | | 9/1976 | Knight | 164/332 |
| 4,098,668 A | | 7/1978 | Andersen et al. | 204/237 |
| 4,201,653 A | | 5/1980 | O'Neill et al. | 204/263 |
| 4,288,305 A | | 9/1981 | Garritsen et al. | 205/269 |
| 5,128,012 A | | 7/1992 | Olsen | 204/245 |
| 5,277,777 A | | 1/1994 | Olper et al. | 204/286 |
| 5,492,608 A | | 2/1996 | Sandoval et al. | 204/237 |
| 5,516,412 A | | 5/1996 | Andricacos et al. | 204/224 R |
| 5,908,540 A | | 6/1999 | Fanti | 204/242 |
| 6,231,730 B1 | * | 5/2001 | Davis et al. | 204/279 |

* cited by examiner

*Primary Examiner*—Bruce F. Bell
(74) *Attorney, Agent, or Firm*—Morriss, Bateman, O'Bryant & Compagni

(57) ABSTRACT

An anode box sized and configured for retaining an anode plate therein is disclosed for use in an electrolytic tank of the type used for electrowinning or electrorefining. The anode box is unitarily formed, thereby rendering the device more resistant to degradation typically caused by the harsh environment of the electrolytic tank. The anode box is also formed with spacer structures which protect and isolate the anode plate from contact with the diaphragm, when used, and from contact with adjacent cathode frames. The anode box may include other elements, such as a port through which liberated gases may be withdrawn.

9 Claims, 2 Drawing Sheets

ANODE BOX FOR ELECTROMETALLURGICAL PROCESSES

BACKGROUND

1. Field of the Invention

This invention relates to electrometallurgical processes, namely electrowinning and electrorefining, in which metals are recovered or refined using industrial-scale electrolysis apparatus. Specifically, this invention relates to an improved anode box design for use in such processes.

2. Description of Related Art

Use of large industrial electrolytic cells for the recovery or refining of metals is well-known and widely practiced, particularly in the mining and metallurgy industry. The design or configuration of large industrial electrolytic cells varies, but they usually comprise a tank containing one or more cathodes positioned in proximity to one or more anodes in a bath of electrolyte. A very common configuration of such apparatus is an elongated tank containing a plurality of vertically-oriented cathode plates alternating with a plurality of anodes.

In the process of recovering metals from the electrolyte, i.e., electrowinning, the electrolyte is a purified solution which contains the recoverable metal and the anodes are insoluble. Each anode in the tank is encased in a sheath or diaphragm of porous media through which the electrolyte moves. When an electrical current in applied, electrolyte moves through the diaphragm causing deposition of the metal species on the cathode with a corresponding decrease in acidity in the fluid within the diaphragm, i.e., in the anolyte, and liberation of a gas. The anode, including the diaphragm, is usually designed to carry the gas away from the anode and to remove anolyte from within the diaphragm to maintain and/or optimize the electrowinning process. Examples of electrowinning cells are disclosed in U.S. Pat. No. 4,201,653 and U.S. Pat. No. 4,288,305.

In electrorefining, a target metal is purified or refined from an anode made of the target metal. Application of electricity to the anode causes the target metal to migrate through the electrolyte to the cathode where it is deposited. In most electrorefining processes, the anode is not encased in a diaphragm. However, the refining of some metals causes a sludge of impurities to form in the bottom of the tank, which can be avoided by placing a diaphragm about the anode.

Anodes used in electrometallurgical processes as previously described typically exist in the form of a flat plate of metal having a bar positioned at one end for hanging the anode in the tank and for providing an electrical bus between the anodes of the tank. U.S. Pat. No. 3,981,353 discloses, for example, a method of producing anode plates for electrowinning processes. U.S. Pat. No. 4,201,653 further discloses a means for separating the diaphragm from the anode plate by providing a spacing device, in recognition of the fact that contact between the diaphragm and anode plate in electrowinning reduces the efficient operation of the process. Other anode designs are disclosed in the prior art in which the anode is not in the form of a plate. Thus, for example, U.S. Pat. No. 5,277,777 describes an anode formed of fork-shaped elements which are maintained in a framework.

The environment of electrometallurgical processing tanks is very harsh on both the cathodes and the anodes. Both the cathodes and anodes can undergo warping as a result of the processing. Further, the cathodes are removed after a processing cycle to remove the metals deposited on the cathode. While the anode, particularly in electrowinning processes, does not need to be withdrawn from the tank as frequently as the cathodes, they nonetheless are subject to contact by the cathodes as the cathodes are being removed, and the anodes can be damaged as a result. Others have recognized the need to protect and isolate the anode plate; however, prior efforts to provide an a protective cover have resulted in the production of devices which are, themselves, subject to degradation from the harsh environment of an electrolytic tank. In particular, anode boxes of the known art are structured from many separate pieces which are bonded together, rendering the device structurally weak and vulnerable to chemical degradation.

It would be advantageous to the art, therefore, to provide a protective member for an anode which is structured to protect and stabilize the anode in both electrowinning and electrorefining processes and to provide isolation from the diaphragm (when used) and adjacent cathodes. It would further be advantageous to provide a protective member for an anode which is structured to resist the damage or degradation which inherently results from exposure to the environment of an electrolyte tank.

BRIEF SUMMARY OF THE INVENTION

In accordance with the present invention, an anode box is provided in which an anode plate is positionable for placement in an electrolytic tank. The anode box is structured to protect and stabilize the anode plate and to isolate the anode from adjacent cathode plates and from the diaphragm, when used. The structure of the present invention is particularly advantageous in that it is unitarily formed, comprising two or three pieces, from materials which render the anode box relatively resistant to chemical and mechanical degradation, thereby providing better protection to the anode plate. The anode box of the present invention may be employed in both electrowinning and electrorefining processes.

The present invention comprises a frame sized to receive an anode plate therein. Specifically, the anode box comprises a frame body having two opposing long sides and a third side joining the two opposing long sides together. The outer-facing or peripheral edges of frame may be preferably shaped to facilitate placement of diaphragm or media bag about the frame body. A continuous, U-shaped slot is formed along the three sides of the body and the open fourth side of the frame thereby provides for insertion of an anode plate into the frame with the peripheral sides of the anode plate being supported by the U-shaped slot. A plurality of spacers extend between the sides of the frame body to isolate the anode plate from contact with an adjacent cathode or a diaphragm. The spacers have inwardly projecting members which contact the anode plate to help center the anode plate within the frame body and to provide a space about the anode plate through which gas liberated in the electrolytic process can escape.

A removable hood structured to span the two opposing long sides is positionable on the frame body to provide a fourth side of the frame body, thereby fully enclosing the anode plate therewithin. The removable hood is structured to support an electrical bus and has a gas release mechanism for releasing chemically-liberated gas from around the anode plate. The removable hood may also be configured with an attachment structure to which a diaphragm, or bag of porous media, may be attached.

The anode box of the present invention is unitarily and integrally formed from materials which are comparatively resistant to chemical and mechanical degradation. For example, the frame body, including the sides and spacers, is formed from polymer materials, such as polypropylene, PVC (polyvinyl chloride) or other materials. A particularly suitable material may, for example, be polypropylene in which is incorporated glass beads. The anode box may preferentially be made by a molding process. The frame body may also be formed by extrusion and then processed by known milling techniques to provide the desired configuration. The anode box of the present invention is, therefore, structurally strong to protect the anode plate and reduce warping of the anode plate, and, because it is unitarily formed, it is not subject to degradation.

BRIEF DESCRIPTION OF THE SEVERAL VIEWS OF THE DRAWINGS

In the drawings, which illustrate what is currently considered to be the best mode for carrying out the invention.

DETAILED DESCRIPTION OF THE INVENTION

Figure 1:
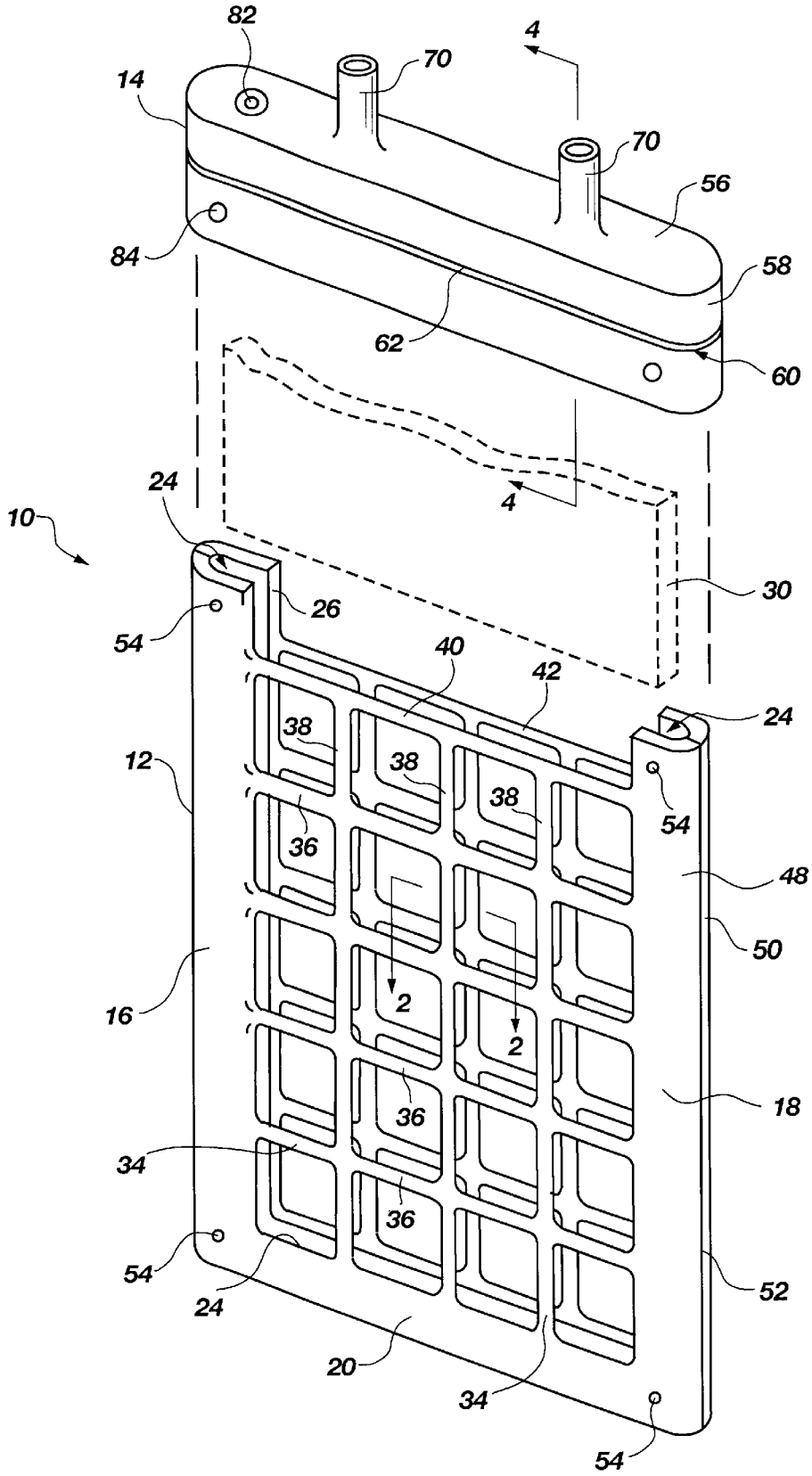
FIG. 1 is a perspective view of the anode box of the invention, shown in an exploded view.

FIG. 1 illustrates the anode box 10 of the present invention which generally comprises a frame body 12 and a removable hood 14. The frame body 12 is further comprised of a first side 16 and a second side 18 oriented in opposition, and parallel, to the first side 16. The frame body 12 also has a third side 20 positioned between the first side 16 and second side 18 of the frame body 12 to provide a three-sided frame structure. An open channel 24 is formed along the inner-facing edge 26 of the first side 16, third side 20 and second side 18 of the frame body 12, thereby forming a continuous channel 24 or slot which is sized to receive the peripheral edge of a planar anode plate 30, a bottom portion of which is suggested by phantom line in FIG. 1.

The anode box 10 of the present invention further includes a plurality of spacers 34 which extend between the sides of the frame body 12. The number of spacers 34 may vary and may be positioned in any direction relative to the sides of the frame body 12. FIG. 1 illustrates but one exemplar configuration where there are a plurality of spacers 34 extending at right angles to each other to form a lattice-like structure on either side of the channel 24 of the frame body 12. That is, a number of parallel and spaced-apart members, nominally designated as horizontal spacers 36, extend between the first side 16 and second side 18 of the frame body 12. A plurality of parallel and spaced-apart members, nominally designated as vertical spacers 38, extend from the third side 20 and intersect the horizontal spacers 36 to form a lattice configuration. A first assemblage 40 of horizontal spacers 36 and vertical spacers 38 is positioned on one side of the continuous channel 24 and a second assemblage 42 of horizontal spacers 36 and vertical spacers 38 is positioned on the other side of the continuous channel 24 such that a lattice configuration of spacers lies adjacent each side of the anode plate 30.

Figure 2:
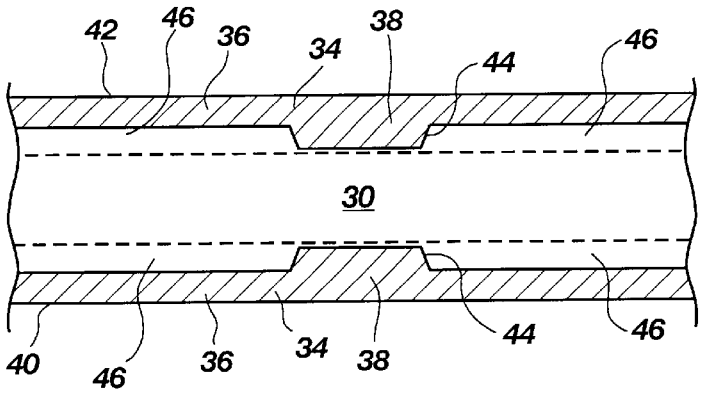
FIG. 2 is a view in lateral cross section of a portion of the anode box shown in FIG. 1, taken at line 2—2.

The configuration of the spacers 34 is further shown in FIG. 2 where it can be seen that the first assemblage 40 of horizontal spacers 36 and vertical spacers 38 is positioned on one side of the anode plate 30 (shown in phantom) and the second assemblage 42 of horizontal spacers 36 and vertical spacers 38 is positioned on the other side of the anode plate 30. It can further be seen that bosses 44 are formed along the spacers 34 (either the horizontal spacers 36 and/or the vertical spacers 38) to extend in the direction of the continuous channel 24 (not shown in FIG. 2). The bosses 44 extend in the proximity of the anode plate 30 may or extend a sufficient distance to contact the anode plate 30. The bosses 44 keep the anode 30 positioned within the frame body 12 and spaced apart from the spacers 34. Additionally, a space 46 is provided between the anode plate 30 and the spacers 34 through which chemically-liberated gas may move during the electrolytic process, as explained more fully below.

Referring again to FIG. 1, it should be noted that the frame body 12 is unitarily formed such that the sides and spacers are integrally formed, from the same material, in a single unit. In one embodiment of the invention, the frame body 12 is singularly formed with three continuous sides and opposing spacer assemblies on either side of the continuous channel. In an alternative embodiment, which is suggested in FIG. 1, the frame body 12 may comprise two unitarily formed, mirror-image lateral sides 48, 50 which are joined along a peripheral edge to form a seam or joint 52. In the latter embodiment, the two lateral sides 48, 50 may be joined by such means as adhesive bonding and/or securement apparatus, such as screws 54.

Figure 3:
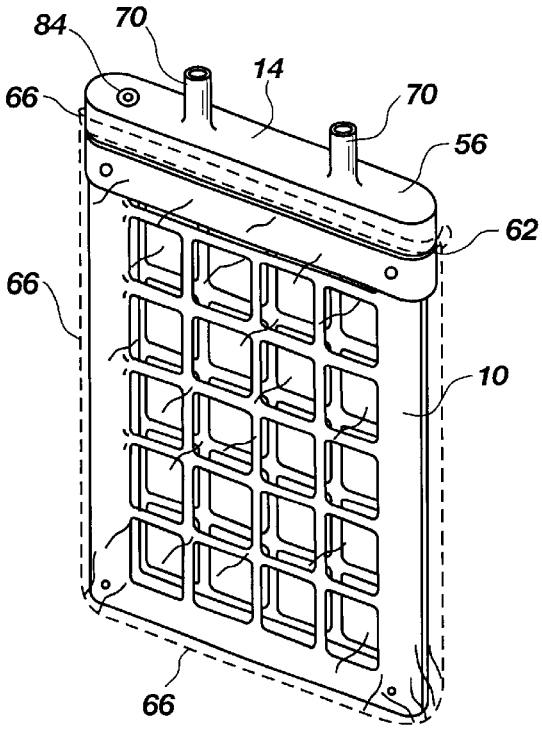
FIG. 3 is a perspective view of the anode box shown in FIG. 1, having a diaphragm (shown in phantom) positioned over the anode box.
Figure 4:
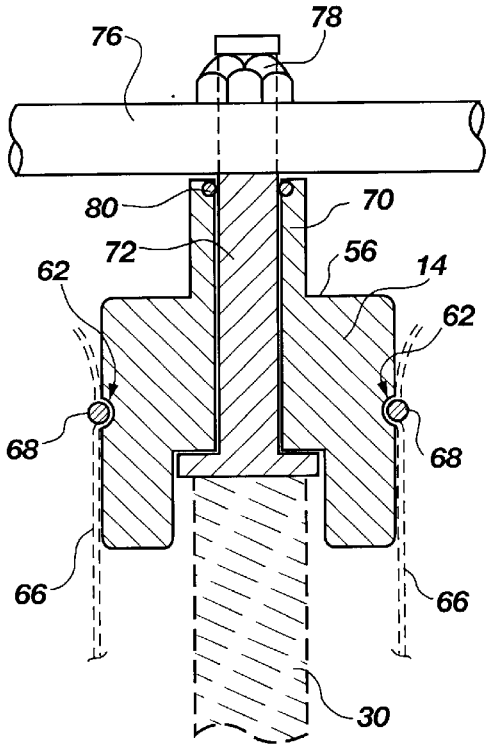
FIG. 4 is a view in longitudinal cross section of the anode box shown in FIG. 1, taken at line 4—4.

The anode box 10 of the present invention further includes a removable hood 14 which is sized to fit over the frame body 12, as shown more clearly in FIG. 3. The removable hood 14 provides a forth side to the anode box 10 which effectively encloses the anode plate therewithin. The removable hood 14 generally has a top 56 and a substantially continuous wall member 58 extending from the top 56. The removable hood 14 may be configured with a securement structure 60 for attaching a diaphragm, or porous media bag, to the anode box 10 when desired. In the illustrated embodiment of FIG. 1, the securement structure 60 is a continuous groove 62 formed along the continuous side wall member 58 to which the diaphragm 66 (FIG. 3, shown in phantom) may be caulked or held by a flexible spline 68, as shown in FIG. 4.

The removable hood 14 is also configured with at least one electrical connector port 70, two such electrical connector ports 70 being illustrated in FIGS. 1 and 3. The electrical connector port 70 provides a means for contacting a source of electricity to the anode plate 30 to power the electrolytic process, and preferably is structured to further provide an electrical bus between or with other anode plates in a tank. In the anode box 10 illustrated in FIGS. 1, 3 and 4, the electrical connector port 70 is configured as a hollow standpipe through which a conductive pin 72 is positionable. The conductive pin 72, as shown in FIG. 4, is sized in length to extend from a position above the electrical connector port 70, through a conductive connecting bar 76 and through the electrical connector port 70 to contact the anode plate 30. The conductive connecting bar 76 spans between the anode plates in an electrolytic tank containing a plurality of cathodes and anodes. The conductive pin 72 may be secured in place by, for example, a nut 78. An electrode seal 80 is provided about the connecting pin 72.

The removable hood 14 may also be configured with a gas vent 82 through which chemically-liberated gas moving through the space 46 between the anode plate 30 and frame body 12 is released. The liberated gas may be vented to the atmosphere through the gas vent 82 or may be vented via a hose (not shown) connected to the gas vent 82. The removable hood 14 may also be configured with attachment members 84 for securing the removable hood 14 to the frame body 12 during use.

The anode box of the present invention provides a device for enclosing an anode plate in an electrolytic tank used for electrowinning or electrorefining. The anode box is particularly configured to protect and isolate the anode plate from contact with the diaphragm, when one is use, and from contact with adjacent cathodes. Moreover, the unitary formation of the anode box of the present invention renders it significantly more resistant to degradation or damage from the environment of the electrolytic tank and, therefore, provides better protection for the anode plate. Many variations may be made in the configuration of the anode box to achieve the objectives enumerated above. Thus, reference herein to specific details of the structure and function of the invention is by reference only and not by way of limitation. Those skilled in the art will recognize that changes may be made to the invention to adapt it accordingly.

What is claimed is:

1. An anode box for retaining an anode plate, comprising:

a frame body unitarily formed having three sides, a continuous channel for receiving the peripheral edges of an anode plate and spacers extending between said three sides of said frame body; and a removable hood sized for attachment to said frame body to further enclose an anode plate therein.

2. The anode box of claim 1 further comprising bosses positioned on said spacers and extending toward said continuous channel.

3. The anode box of claim 2 wherein said removable hood is further configured with at least one electrical connection port through which electricity is provided to an anode plate positioned within said anode box.

4. The anode box of claim 3 wherein said removable hood is further configured with a gas vent through which chemically-liberated gas is released from said anode box.

5. The anode box of claim 1 wherein said spacers are positioned on either side of and parallel to said continuous channel.

6. The anode box of claim 1 further comprising securement structure for attachment of a diaphragm to said anode box.

7. The anode box of claim 6 wherein said securement structure is positioned on said removable hood.

8. The anode box of claim 7 wherein said securement structure is a channel formed about said removable hood to which a diaphragm is attachable.

9. The anode box of claim 1 wherein said frame body is further comprised of two unitarily formed mirror-image lateral sides, each having a peripheral edge about which each lateral side is joinable to the other lateral side.

* * * * *